US006855898B2

(12) United States Patent
Wong et al.

(10) Patent No.: US 6,855,898 B2
(45) Date of Patent: Feb. 15, 2005

(54) CERAMIC CHANNEL PLATE FOR A SWITCH

(75) Inventors: Marvin Glenn Wong, Woodland Park, CO (US); Paul Thomas Carson, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 52 days.

(21) Appl. No.: 10/317,960

(22) Filed: Dec. 12, 2002

(65) Prior Publication Data

US 2004/0112728 A1 Jun. 17, 2004

(51) Int. Cl.[7] ..... H01H 29/00
(52) U.S. Cl. ..... 200/182; 200/193
(58) Field of Search ..... 200/181, 182, 200/185, 188, 193, 211, 213, 214, 221, 286, 61.02, 182.1, 85; 310/328, 363, 365; 219/209, 210

(56) References Cited

U.S. PATENT DOCUMENTS

| | | | | |
|---|---|---|---|---|
| 2,312,672 A | | 3/1943 | Pollard, Jr. | |
| 2,564,081 A | | 8/1951 | Schilling | |
| 3,430,020 A | | 2/1969 | Von Tomkewitsch et al. | |
| 3,529,268 A | | 9/1970 | Rauterberg | |
| 3,600,537 A | | 8/1971 | Twyford | |
| 3,639,165 A | | 2/1972 | Rairden, III | |
| 3,657,647 A | | 4/1972 | Beusman et al. | |
| 4,103,135 A | | 7/1978 | Gomez et al. | |
| 4,200,779 A | | 4/1980 | Zakurdaev et al. | |
| 4,238,748 A | | 12/1980 | Goullin et al. | |
| 4,245,886 A | | 1/1981 | Kolodzey et al. | |
| 4,336,570 A | | 6/1982 | Brower | |
| 4,419,650 A | | 12/1983 | John | |
| 4,434,337 A | | 2/1984 | Becker | |
| 4,475,033 A | | 10/1984 | Willemsen et al. | |
| 4,505,539 A | | 3/1985 | Auracher et al. | |
| 4,582,391 A | | 4/1986 | Legrand | |
| 4,628,161 A | | 12/1986 | Thackrey | |
| 4,639,999 A | * | 2/1987 | Daniele | 438/34 |
| 4,652,710 A | | 3/1987 | Karnowsky et al. | |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | SHO 36-18575 | 10/1961 |
| JP | SHO 47-21645 | 10/1972 |
| JP | 63-294317 | 12/1988 |
| JP | 9-161640 | 6/1997 |

OTHER PUBLICATIONS

TDB–ACC–NO: NB8406827, "Integral Power Resistors For Aluminum Substrate", IBM Technical Disclosure Bulletin, Jun. 1984, US, vol. 27, Issue No. 1B, p. 827.

Marvin Glenn Wong, "A Piezoelectrically Actuated Liquid Metal Switch", May 2, 2002, patent application (pending), 12 pages of specification, 5 pages of claims, 1 page of abstract, and 10 sheets of drawings (Figs. 1–10).

(List continued on next page.)

*Primary Examiner*—Elvin Enad
*Assistant Examiner*—Lisa Klaus

(57) ABSTRACT

Disclosed herein is a channel plate for a fluid-based switch. The channel plate is produced by 1) forming a plurality of channel plate layers in ceramic green sheet, 2) forming at least one channel plate feature in at least one of the channel plate layers, and 3) laminating the channel plate layers to form the channel plate. Switches using ceramic channel plates, and a method for making a switch with a ceramic channel plate, are also disclosed.

13 Claims, 6 Drawing Sheets

U.S. PATENT DOCUMENTS 4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 * 11/2001 Kondoh et al. ..... 200/182
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

OTHER PUBLICATIONS

Homi C. Bhedwar et al., "Ceramic Multilayer Package Fabrication", Nov. 1989, Electronic Materials Handbook, vol. 1 Packaging, Section 4: Packages, pp. 460–469.
Joonwon Kim et al., "A Micromechanical Switch with Electrostatically Driven Liquid–Metal Droplet", Sensors and Actuators, A:Physical. v 9798, Apr. 1, 2002, 4 pages.
Jonathan Simon et al., "A Liquid–Filled Microrelay with a Moving Mercury Microdrop", Journal of Microelectromechanical Systems, vol. 6, No. 3, Sep. 1977, pp. 208–216.
Marvin Glenn Wong, "Laser Cut Channel Plate for a Switch", patent application, 11 pages of specification, 5 pages of claims, 1 page of abstract, and 4 sheets of formal drawings (Figs. 1–10).

* cited by examiner

CERAMIC CHANNEL PLATE FOR A SWITCH

BACKGROUND

Channel plates for liquid metal micro switches (LIMMS) can be made by sandblasting channels into glass plates, and then selectively metallizing regions of the channels to make them wettable by mercury or other liquid metals. One problem with the current state of the art, however, is that the feature tolerances of channels produced by sandblasting are sometimes unacceptable (e.g., variances in channel width on the order of ±20% are sometimes encountered). Such variances complicate the construction and assembly of switch components, and also place limits on a switch's size (i.e., there comes a point where the expected variance in a feature's size overtakes the size of the feature itself).

SUMMARY OF THE INVENTION

One aspect of the invention is embodied in a channel plate for a fluid-based switch. The channel plate is produced by 1) forming a plurality of channel plate layers in ceramic green sheet, 2) forming at least one channel plate feature in at least one of the channel plate layers, and 3) laminating the channel plate layers to form the channel plate.

Another aspect of the invention is embodied in a switch comprising a ceramic channel plate and a switching fluid. The ceramic channel plate defines at least a portion of a number of cavities, a first of which is defined by a first channel formed in the ceramic channel plate. The switching fluid is held within one or more of the cavities, and is movable between at least first and second switch states in response to forces that are applied to the switching fluid.

Other embodiments of the invention are also disclosed.

BRIEF DESCRIPTION OF THE DRAWINGS

Illustrative embodiments of the invention are illustrated in the drawings, in which.

DETAILED DESCRIPTION OF THE INVENTION

When sandblasting channels into a glass plate, there are limits on the feature tolerances of the channels. For example, when sandblasting a channel having a width measured in tenths of millimeters (using, for example, a ZERO automated blasting machine manufactured by Clemco Industries Corporation of Washington, Mo., USA), variances in channel width on the order of ±20% are sometimes encountered. Large variances in channel length and depth are also encountered. Such variances complicate the construction and assembly of liquid metal micro switch (LIMMS) components. For example, channel variations within and between glass channel plate wafers require the dispensing of precise, but varying, amounts of liquid metal for each channel plate. Channel feature variations also place a limit on the sizes of LIMMS (i.e., there comes a point where the expected variance in a feature's size overtakes the size of the feature itself).

In an attempt to remedy some or all of the above problems, ceramic channel plates, and methods for making same, are disclosed herein. It should be noted, however, that the channel plates and methods disclosed may be suited to solving other problems, either now known or that will arise in the future.

Depending on how channels are formed in a ceramic channel plate, variances in channel width for channels measured in tenths of millimeters (or smaller) can be reduced to about ±10%, or even about ±3%, using the methods and apparatus disclosed herein.

Figure 1:
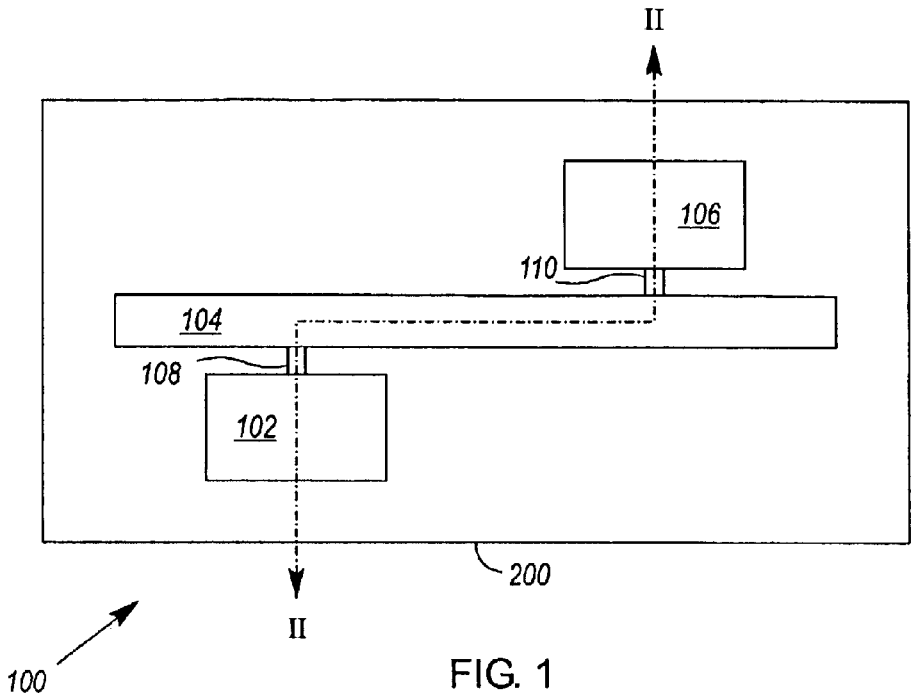
FIG. 1 illustrates an exemplary plan view of a ceramic channel plate for a switch.
Figure 2:
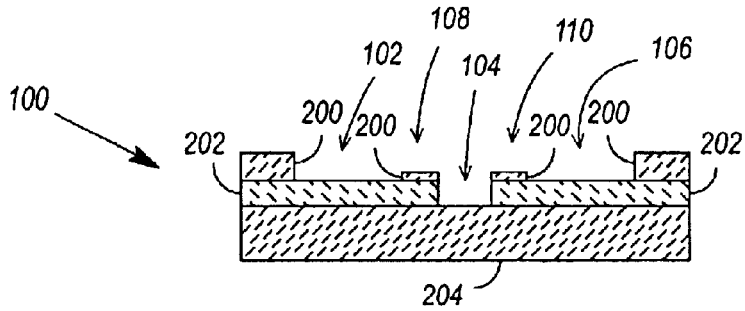
FIG. 2 illustrates an elevation view of the FIG. 1 channel plate.
Figure 3:
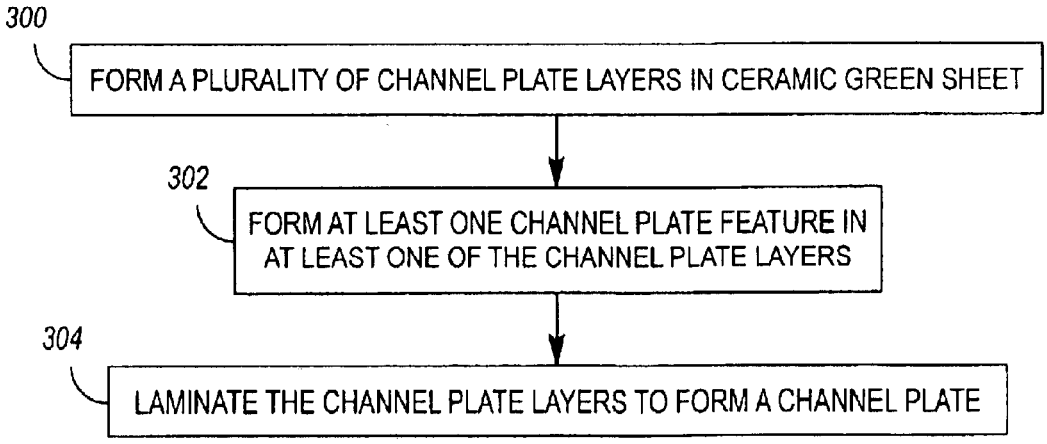
FIG. 3 illustrates a method for producing the FIG. 1 channel plate.

FIGS. 1 & 2 illustrate a first exemplary embodiment of a ceramic channel plate 100 for a fluid-based switch such as a LIMMS. As illustrated in FIG. 3, the channel plate 100 may be produced by 1) forming 300 a plurality of channel plate layers 200, 202, 204 (see FIG. 2) in ceramic green sheet, 2) forming 302 at least one channel plate feature 102, 104, 106, 108, 110 in at least one of the channel plate layers 200–204 (see FIGS. 1 & 2), and 3) laminating 304 the channel plate layers 200–204 to form the channel plate 100. Note that the last two steps 302, 304 need not be performed in the order shown in FIG. 3 and, depending on the feature, it might be desirable to form the feature before and/or after the lamination process, as will be discussed later in this description.

Ceramic green sheets (or tapes) are layers of unfired ceramic that typically comprise a mixture of ceramic and glass powder, organic binder, plasticizers, and solvents. The formation of ceramic green sheets is within the knowledge of one of ordinary skill in the art. However, in general, a ceramic green sheet is created by mixing the above listed components to form a "slip", and then casting the slip (e.g., via doctor blading) to form a thin sheet (or tape). The sheet may then be dried. Multiple green sheets may "laminated" by, for example, stacking the sheets and firing them at a high temperature.

The different channel plate layers 200–204 may all be formed in the same ceramic green sheet (e.g., a single green sheet "wafer"), or may be formed in different ceramic green sheets. The latter may be preferable in that it enables the formation of a plurality of channel plates in parallel.

Alignment of the ceramic green sheets for purposes of lamination may be achieved by providing each green sheet with a set of alignment holes or notches, and then stacking the green sheets on an alignment jig fitted with tooling pins that are aligned with the holes or notches.

Figure 4:
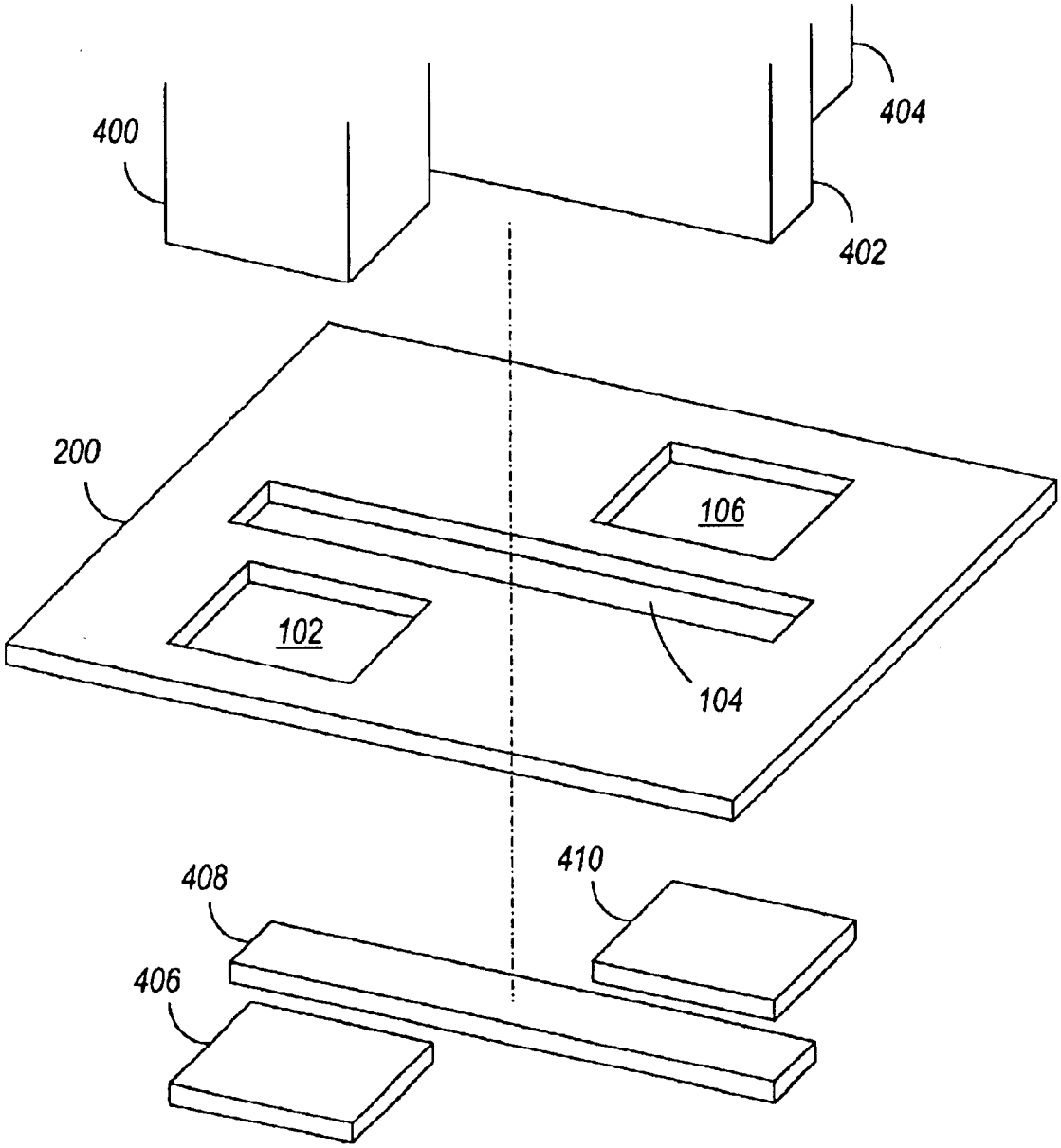
FIG. 4 illustrates the punching of a channel plate feature from a ceramic channel plate layer.

Channel plate features 102–110 may be formed in channel plate layers 200–204 either before or after the layers are laminated, and either before or after ones of the green sheets have been aligned for purposes of lamination. For example, and as shown in FIG. 4, channel plate features 102–106 may be formed in a channel plate layer 200 while the layer is still in its green sheet form (and before the layer is laminated to other layers). In FIG. 4, channel plate features 102–106 are punched or stamped from a channel plate layer 200 (thereby creating a number of refuse pieces 406–410). A machine that might be used for such a punching process is the Ushio punching machine manufactured by Ushio, Inc. of Tokyo, Japan. Machines such as this are able to punch a plurality of features 102–106 at once (e.g., via blades or punches 400, 402, 404), thereby making punching a parallel feature formation process.

Figure 5:
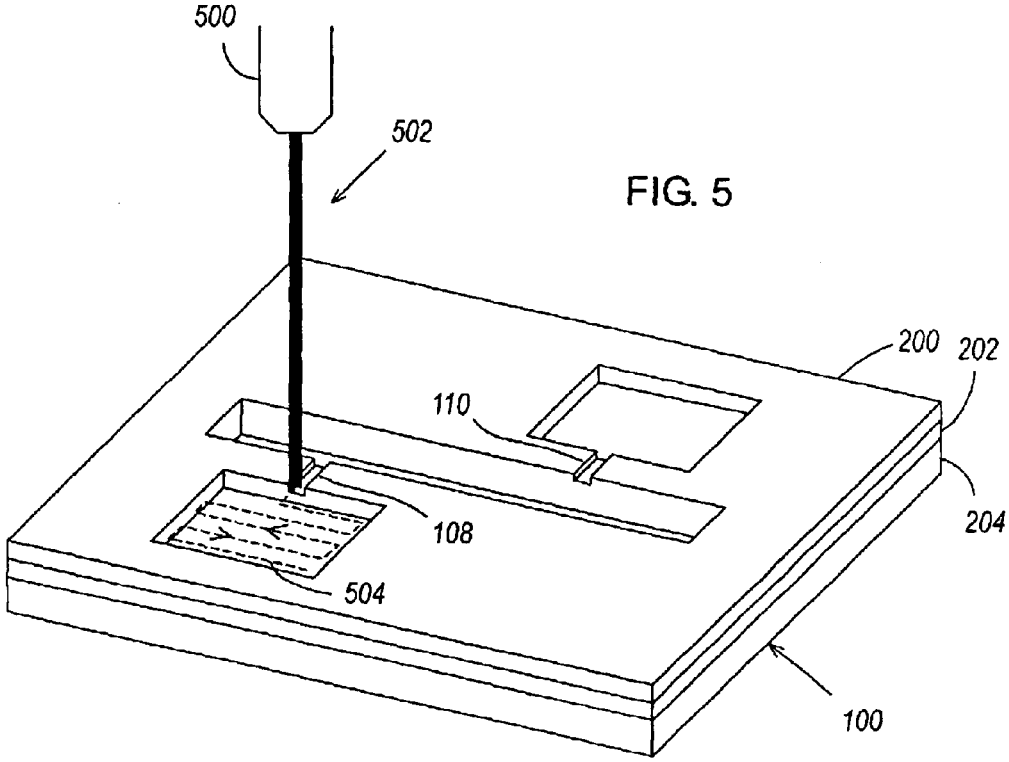
FIG. 5 illustrates the laser cutting of a channel plate feature into a ceramic channel plate layer.

FIG. 5 illustrates how a channel plate feature 108 can be laser cut into a channel plate layer 200. To begin, the power of a laser 500 is regulated to control the cutting depth of a laser beam 502. The beam 502 is then moved into position over a channel plate layer 200 and moved (e.g., in the direction of arrow 504) to cut a feature 108 into the channel plate layer 200. If the beam 502 has an adjustable width, the width of the beam 502 may be adjusted to match the width of a feature 108 that is to be cut. Otherwise, multiple passes of the beam 502 may be needed to cut a feature "to width". A machine that might be used for such a cutting process is the Nd-YAG laser cutting system (a YAG laser system) manufactured by Enlight Technologies, Inc. of Branchburg, N.J., USA. The laser cutting of channels in a channel plate is further described in the U.S. patent application Ser. No. 10/317,932 of Marvin Glenn Wong entitled "Laser Cut Channel Plate for a Switch" (filed on the same date as this patent application, which is hereby incorporated by reference for all that it discloses.

Note that in FIG. 5, a number of channel plate layers 200–204 are shown to be stacked (and possibly laminated). However, laser cutting can also be performed prior to channel plate layers 200–204 being stacked and/or laminated.

Figure 6:
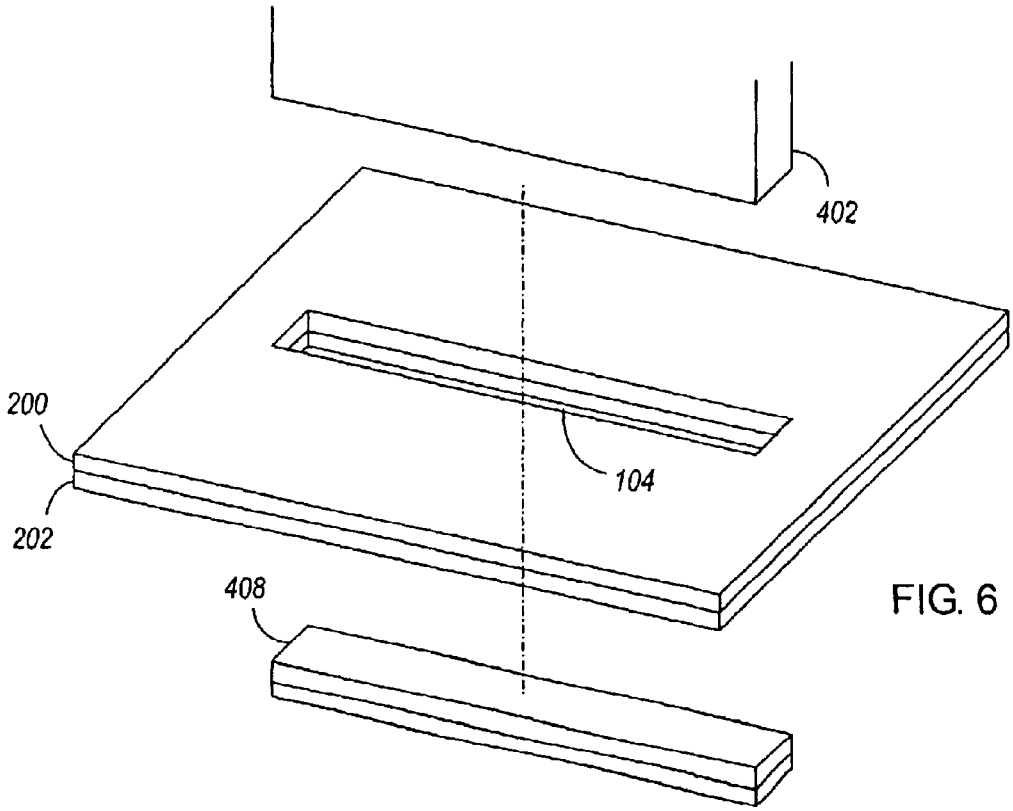
FIG. 6 illustrates the formation of a channel plate feature in two ceramic channel plate layers that are aligned prior to formation of the feature.

If a channel plate feature 104 extends through two or more channel plate layers 200, 202, the feature may be separately punched from (or laser cut into) each of the layers, and the layers may then be aligned to form the feature as a whole (e.g., see FIG. 2, wherein the central channel 104 of a channel plate is shown to be two layers deep). Such a feature may alternately be formed as shown in FIG. 6. In FIG. 6, two channel plate layers 200, 202 are aligned prior to the formation of a channel plate feature 104 so that the same process (e.g., punching or laser cutting) may be used to form the feature in each of the layers.

As previously discussed, punching features 102–110 from channel plate layers 200–204 is advantageous in that punching machines are relatively fast, and it is possible to punch more than one feature in a single pass. Feature tolerances provided by punching are on the order of ±10%. Laser cutting, on the other hand, can reduce feature tolerances to ±3%. Thus, when only minor feature variances can be tolerated, laser cutting may be preferred over punching. It should be noted, however, that the above recited feature tolerances are subject to variance depending on the machine that is used, and the size of the feature to be formed.

In one embodiment of the FIG. 3 method, larger channel plate features (e.g., features 102–106 in FIG. 1) are punched from channel plate layers, and smaller channel plate features (e.g., features 108 and 110 in FIG. 1) are laser cut into channel plate layers. In the context of currently available punching and laser cutting machines, it is believed useful to define "larger channel plate features" as those having widths of about 200 microns or greater. Likewise, "smaller channel plate features" may be defined as those having widths of about 200 microns or smaller.

In one exemplary embodiment of the invention (see FIGS. 1 & 2), a channel plate 100 comprises three layers 200–204, and the features that are formed in these layers comprise a switching fluid channel 104, a pair of actuating fluid channels 102, 106, and a pair of channels 108, 110 that connect corresponding ones of the actuating fluid channels 102, 106 to the switching fluid channel 104 (NOTE: The usefulness of these features in the context of a switch will be discussed later in this description.). A first of the channel plate layers 204 may serve as a base and may not have any features formed therein. The switching fluid channel 104 (having a width of about 200 microns, a length of about 2600 microns, and a depth of about 200 microns) may be punched from each of the second and third layers 202, 200 such that a "deep" channel is formed when the first, second and third layers 200–204 are laminated to one another. The actuating fluid channels 102, 106 (each having a width of about 350 microns, a length of about 1400 microns, and a depth of about 300 microns) may be punched from the third layer 200 only. The channels 108, 110 that connect the actuating fluid channels 102, 106 to the switching fluid channel 104 (each having a width of about 100 microns, a length of about 600 microns, and a depth of about 130 microns) may then be laser cut into the third channel plate layer 200.

It is envisioned that more or fewer channels may be formed in a channel plate, depending on the configuration of the switch in which the channel plate is to be used. For example, and as will become more clear after reading the following descriptions of various switches, the pair of actuating fluid channels 102, 106 and pair of connecting channels 108, 110 disclosed in the preceding paragraph may be replaced by a single actuating fluid channel and single connecting channel.

Figure 7:
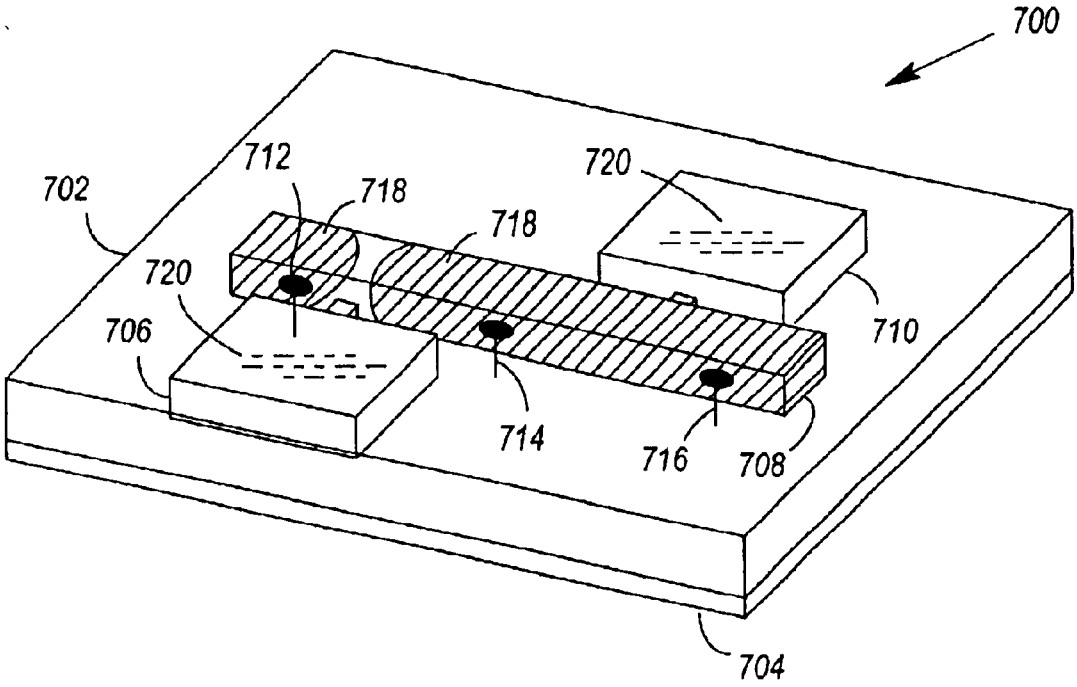
FIG. 7 illustrates a first exemplary embodiment of a switch having a ceramic channel plate.

FIG. 7 illustrates a first exemplary embodiment of a switch 700. The switch 700 comprises a ceramic channel plate 702 defining at least a portion of a number of cavities 706, 708, 710, a first cavity of which is defined by a first channel formed in the ceramic channel plate 702. The remaining portions of the cavities 706–710, if any, may be defined by a substrate 704 to which the channel plate 702 is sealed. Exposed within one or more of the cavities are a plurality of electrodes 712, 714, 716. A switching fluid 718 (e.g., a conductive liquid metal such as mercury) held within one or more of the cavities serves to open and close at least a pair of the plurality of electrodes 712–716 in response to forces that are applied to the switching fluid 718. An actuating fluid 720 (e.g., an inert gas or liquid) held within one or more of the cavities serves to apply the forces to the switching fluid 718.

In one embodiment of the switch 700, the forces applied to the switching fluid 718 result from pressure changes in the actuating fluid 720. The pressure changes in the actuating fluid 720 impart pressure changes to the switching fluid 718, and thereby cause the switching fluid 718 to change form, move, part, etc. In FIG. 7, the pressure of the actuating fluid 720 held in cavity 706 applies a force to part the switching fluid 718 as illustrated. In this state, the rightmost pair of electrodes 714, 716 of the switch 700 are coupled to one another. If the pressure of the actuating fluid 720 held in cavity 706 is relieved, and the pressure of the actuating fluid 720 held in cavity 710 is increased, the switching fluid 718 can be forced to part and merge so that electrodes 714 and 716 are decoupled and electrodes 712 and 714 are coupled.

By way of example, pressure changes in the actuating fluid 720 may be achieved by means of heating the actuating fluid 720, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference for all that it discloses. The latter is described in U.S. patent application Ser. No. 10/137,691 of Marvin Glenn Wong filed May 2, 2002 and entitled "A Piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. In such an arrangement, a ceramic channel plate could be constructed for the switch as disclosed herein.

The channel plate 702 of the switch 700 may comprise a plurality of laminated channel plate layers with features formed therein as illustrated in FIGS. 1–6. In one embodiment of the switch 700, the first channel in the channel plate 702 defines at least a portion of the one or more cavities 708 that hold the switching fluid 718. If this channel is sized similarly to the switching fluid channel 104 illustrated in FIGS. 1 & 2, then it may be preferable to punch this channel from one or more of the channel plate's layers.

A second channel (or channels) may be formed in the channel plate 702 so as to define at least a portion of the one or more cavities 706, 710 that hold the actuating fluid 720. If these channels are sized similarly to the actuating fluid channels 102, 106 illustrated in FIGS. 1 & 2, then it may also be preferable to punch these channels from one or more of the channel plate's layers.

A third channel (or channels) may be formed in the channel plate 702 so as to define at least a portion of one or more cavities that connect the cavities 706–710 holding the switching and actuating fluids 718, 720. If these channels are sized similarly to the connecting channels 108, 110 illustrated in FIGS. 1 & 2, then it may be preferable to laser cut these channels into one or more of the channel plate's layers.

Additional details concerning the construction and operation of a switch such as that which is illustrated in FIG. 7 may be found in the aforementioned patent of Kondoh et al. and patent application of Marvin Wong.

Figure 8:
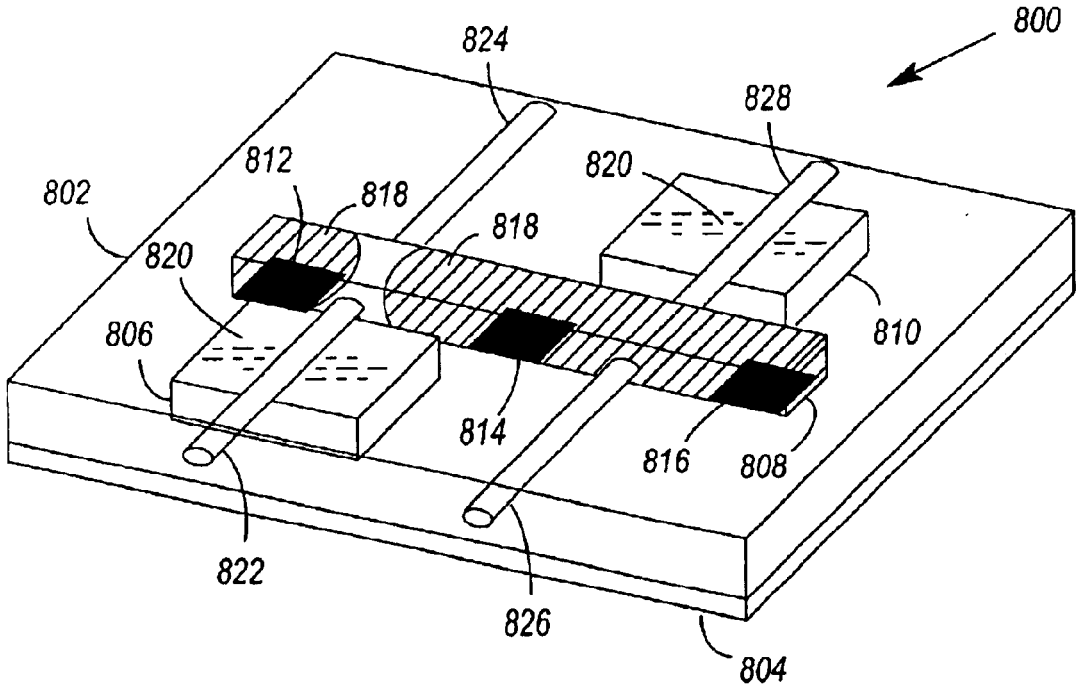
FIG. 8 illustrates a second exemplary embodiment of a switch having a ceramic channel plate.

FIG. 8 illustrates a second exemplary embodiment of a switch 800. The switch 800 comprises a ceramic channel plate 802 defining at least a portion of a number of cavities 806, 808, 810, a first cavity of which is defined by a first channel formed in the ceramic channel plate 802. The remaining portions of the cavities 806–810, if any, may be defined by a substrate 804 to which the channel plate 802 is sealed. Exposed within one or more of the cavities are a plurality of wettable pads 812–816. A switching fluid 818 (e.g., a liquid metal such as mercury) is wettable to the pads 812–816 and is held within one or more of the cavities. The switching fluid 818 serves to open and block light paths 822/824, 826/828 through one or more of the cavities, in response to forces that are applied to the switching fluid 818. By way of example, the light paths may be defined by waveguides 822–828 that are aligned with translucent windows in the cavity 808 holding the switching fluid. Blocking of the light paths 822/824, 826/828 may be achieved by virtue of the switching fluid 818 being opaque. An actuating fluid 820 (e.g., an inert gas or liquid) held within one or more of the cavities serves to apply the forces to the switching fluid 818.

Forces may be applied to the switching and actuating fluids 818, 820 in the same manner that they are applied to the switching and actuating fluids 718, 720 in FIG. 7.

The channel plate 802 of the switch 800 may comprise a plurality of laminated channel plate layers with features 102–110 formed therein as illustrated in FIGS. 1–6. In one embodiment of the switch 800, the first channel in the channel plate 802 defines at least a portion of the one or more cavities 808 that hold the switching fluid 818. If this channel is sized similarly to the switching fluid channel 104 illustrated in FIGS. 1 & 2, then it may be preferable to punch this channel from one or more of the channel plate's layers.

A second channel (or channels) may be formed in the channel plate 802 so as to define at least a portion of the one or more cavities 806, 810 that hold the actuating fluid 820. If these channels are sized similarly to the actuating fluid channels 102,106 illustrated in FIGS. 1 & 2, then it may be preferable to punch these channels from one or more of the channel plate's layers.

A third channel (or channels) may be formed in the channel plate 802 so as to define at least a portion of one or more cavities 806–810 that connect the cavities holding the switching and actuating fluids 818, 820. If these channels are sized similarly to the connecting channels 108, 110 illustrated in FIGS. 1 & 2, then it may be preferable to laser cut these channels into one or more of the channel plate's layers.

Additional details concerning the construction and operation of a switch such as that which is illustrated in FIG. 8 may be found in the aforementioned patent of Kondoh et al. and patent application of Marvin Wong.

The type of channel plate 100 and method for making same disclosed in FIGS. 1–6 are not limited to use with the switches 700, 800 disclosed in FIGS. 7 & 8 and may be used in conjunction with other forms of switches that comprise, for example, 1) a ceramic channel plate defining at least a portion of a number of cavities, a first cavity of which is defined by a first channel formed in the ceramic channel plate, and 2) a switching fluid, held within one or more of the cavities, that is movable between at least first and second switch states in response to forces that are applied to the switching fluid.

Figure 9:
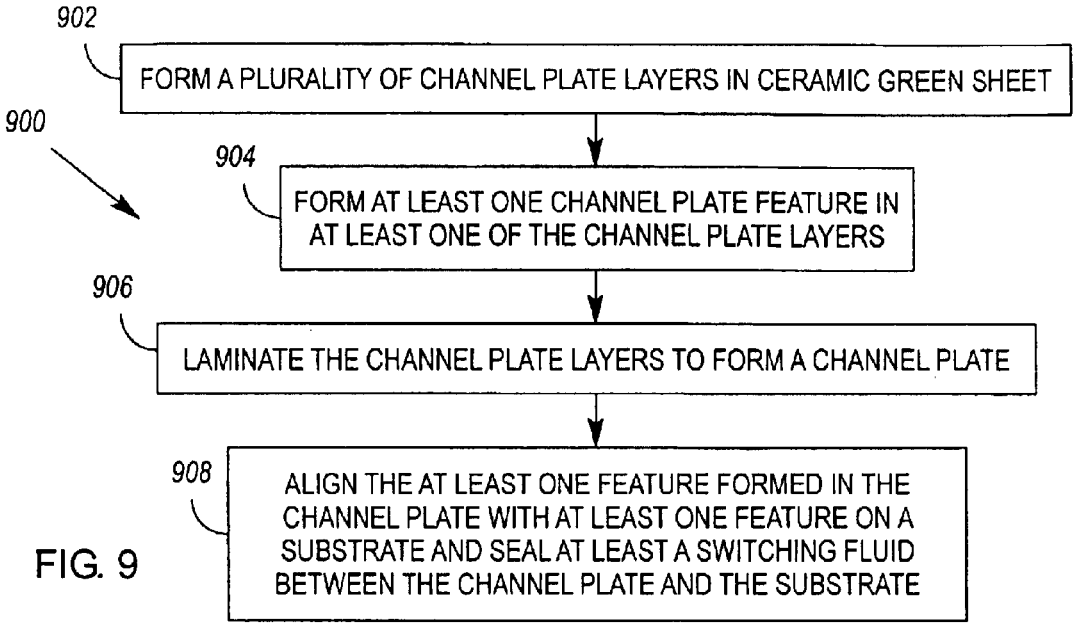
FIG. 9 illustrates an exemplary method for making a fluid-based switch.

An exemplary method 900 for making a fluid-based switch is illustrated in FIG. 9. The method 900 commences with the formation 902 of a plurality of channel plate layers in ceramic green sheet. At least one channel plate feature is then formed 904 in the at least one of the channel plate layers, and the channel plate layers are laminated 906 to form a channel plate (NOTE, however, that these steps need not be performed in the order shown.). Optionally, portions of the channel plate may then be metallized (e.g., via sputtering or evaporating through a shadow mask, or via etching through a photoresist). Finally, features formed in the channel plate are aligned with features formed on a substrate, and at least a switching fluid (and possibly an actuating fluid) is sealed 908 between the channel plate and a substrate.

Figure 10:
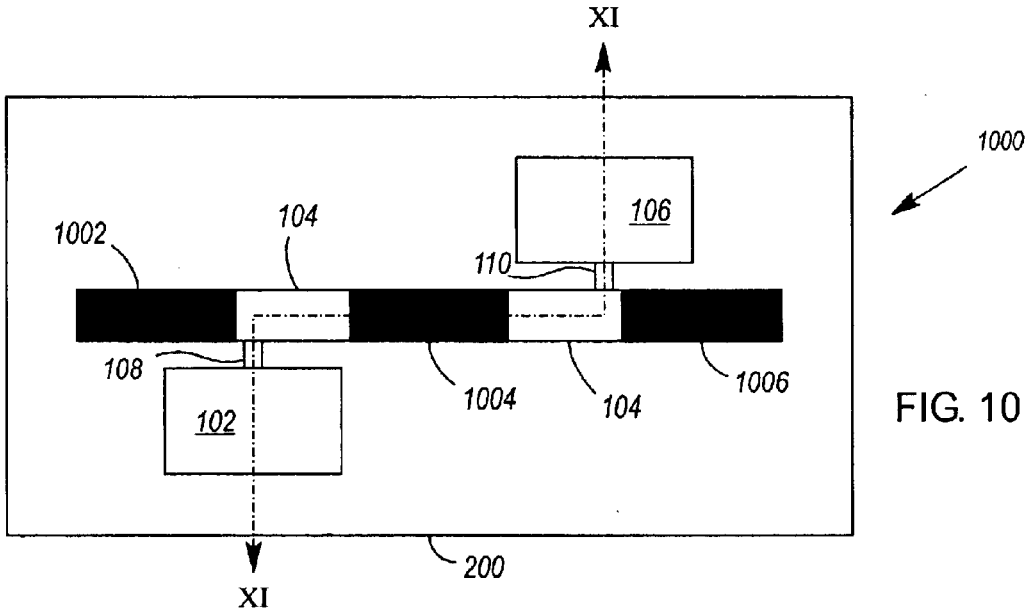
FIGS. 10 & 11 illustrate the metallization of portions of the FIG. 1 channel plate.
Figure 11:
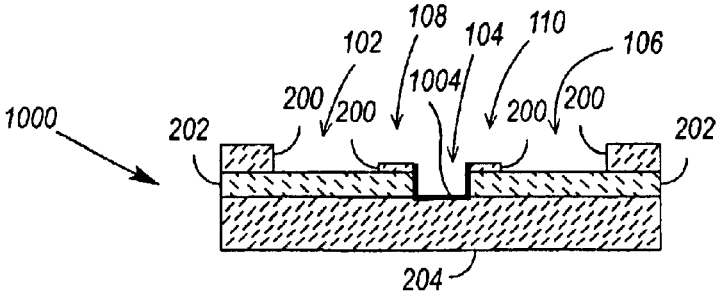

FIGS. 10 & 11 illustrate how portions of a channel plate 1000 similar to that which is illustrated in FIGS. 1 & 2 may be metallized for the purpose of creating "seal belts" 1002, 1004, 1006. The creation of seal belts 1002–1006 within a switching fluid channel 104 provides additional surface areas to which a switching fluid may wet. This not only helps in latching the various states that a switching fluid can assume, but also helps to create a sealed chamber from which the switching fluid cannot escape, and within which the switching fluid may be more easily pumped (i.e., during switch state changes).

Figure 12:
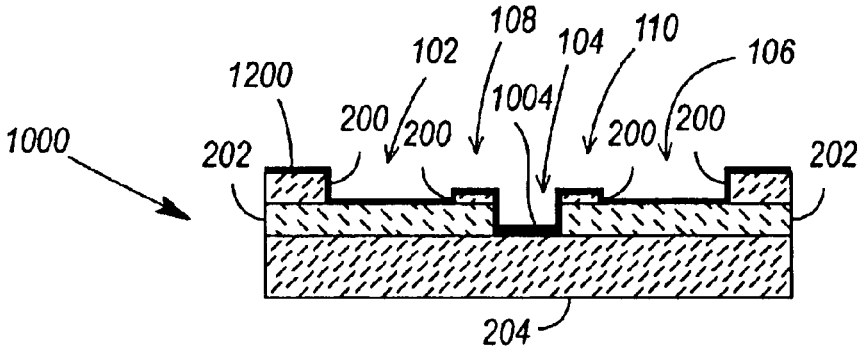
FIG. 12 illustrates the application of an adhesive to the FIG. 11 channel plate.
Figure 13:
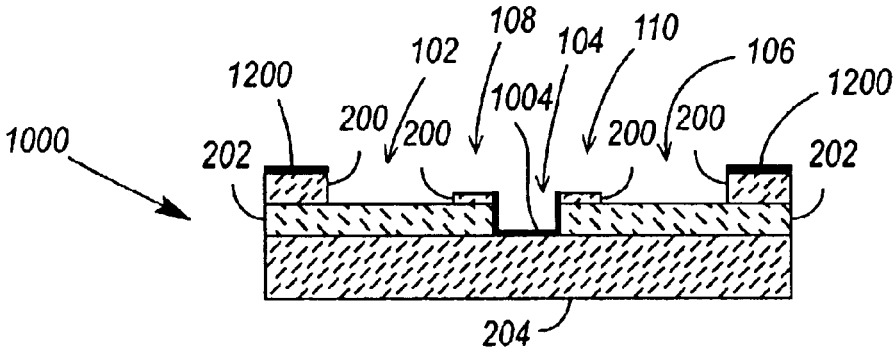
FIG. 13 illustrates the FIG. 12 channel plate after laser ablation of the adhesive from the plate's channels.

One way to seal a switching fluid between a channel plate and a substrate is by means of an adhesive applied to the channel plate. FIGS. 12 & 13 therefore illustrate how an adhesive (such as the Cytop™ adhesive manufactured by Asahi Glass Co., Ltd. of Tokyo, Japan) may be applied to the FIG. 11 channel plate 1000. The adhesive 1200 may be spin-coated or spray coated onto the channel plate 1000 and cured. Laser ablation may then be used to remove the adhesive from channels and/or other channel plate features (see FIG. 13).

Although FIGS. 10–13 disclose the creation of seal belts 1002–1006 on a channel plate 1000, followed by the application of an adhesive 1200 to the channel plate 1000, these processes could alternately be reversed.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch, comprising:

a) a ceramic channel plate defining at least a portion of a number of cavities, a first cavity of which is defined by a first channel formed in the ceramic channel plate;

b) a plurality of electrodes exposed within one or more of the cavities;

c) a switching fluid, held within one or more of the cavities, that serves to open and close at least a pair of the plurality of electrodes in response to forces that are applied to the switching fluid; and d) an actuating fluid, held within one or more of the cavities, that serves to apply said forces to the switching fluid.

2. The switch of claim 1, wherein the ceramic channel plate comprises a plurality of laminated channel plate layers.

3. The switch of claim 2, wherein the first channel defines at least a portion of the one or more cavities that hold the switching fluid, and wherein the first channel is punched from one or more of the channel plate layers.

4. The switch of claim 3, wherein:

a) a second channel formed in the ceramic channel plate defines at least a portion of the one or more cavities that hold the actuating fluid, and wherein the second channel is punched from one or more of the channel plate layers; and b) a third channel formed in the ceramic channel plate defines at least a portion of one or more cavities that connect the cavities holding the switching and actuating fluids, and wherein the third channel is laser cut into one or more of the channel plate layers.

5. The switch of claim 1, wherein the channels formed in the channel plate comprise a channel that defines at least a portion of the one or more cavities that hold the switching fluid, a pair of channels that define at least a portion of the one or more cavities that hold the actuating fluid, and a pair of channels connecting corresponding ones of the channels that hold the actuating fluid to the channel that holds the switching fluid.

6. A switch, comprising:

a) a ceramic channel plate defining at least a portion of a number of cavities, a first of which is defined by a first channel formed in the ceramic channel plate;

b) a plurality of wettable pads exposed within one or more of the cavities;

c) a switching fluid, wettable to said pads and held within one or more of the cavities, that serves to open and block light paths through one or more of the cavities in response to forces that are applied to the switching fluid; and d) an actuating fluid, held within one or more of the cavities, that serves to apply said forces to the switching fluid.

7. The switch of claim 6, wherein the ceramic channel plate comprises a plurality of laminated channel plate layers.

8. The switch of claim 7, wherein the first channel defines at least a portion of the one or more cavities that hold the switching fluid, and wherein the first channel is punched from one or more of the channel plate layers.

9. The switch of claim 8, wherein:

a) a second channel formed in the ceramic channel plate defines at least a portion of the one or more cavities that hold the actuating fluid, and wherein the second channel is punched from one or more of the channel plate layers; and b) a third channel formed in the ceramic channel plate defines at least a portion of one or more cavities that connect the cavities holding the switching and actuating fluids, and wherein the third channel is laser cut into one or more of the channel plate layers.

10. The switch of claim 6, wherein the channels formed in the channel plate comprise a channel that defines at least a portion of the one or more cavities that hold the switching fluid, a pair of channels that define at least a portion of the one or more cavities that hold the actuating fluid, and a pair of channels connecting corresponding ones of the channels that hold the actuating fluid to the channel that holds the switching fluid.

11. A switch, comprising:

a) a ceramic channel plate comprised of a plurality of laminated channel plate layers, the ceramic channel plate defining at least a portion of a number of cavities, a first cavity of which is defined by a first channel formed in the ceramic channel plate;

b) a switching fluid, held within one or more of the cavities, that is movable between at least first and second switch states in response to forces that are applied to the switching fluid.

12. The switch of claim 11, wherein the first channel defines at least a portion of the one or more cavities that hold the switching fluid, and wherein the first channel is punched from one or more of the channel plate layers.

13. The switch of claim 12, wherein a second channel formed in the ceramic channel plate defines at least a portion of a cavity from which the forces are applied to the switching fluid.

* * * * *